US007861555B2

(12) United States Patent
Seliktar

(10) Patent No.: US 7,861,555 B2
(45) **Date of Patent: *Jan. 4, 2011**

(54) ARTICLE OF JEWELRY

(75) Inventor: Ronen Seliktar, Long Island City, NY (US)

(73) Assignee: Select Jewelry, Inc., Long Island City, NY (US)

( * ) Notice: Subject to any disclaimer, the term of this patent is extended or adjusted under 35 U.S.C. 154(b) by 978 days.

This patent is subject to a terminal disclaimer.

(21) Appl. No.: 11/604,576

(22) Filed: Nov. 27, 2006

(65) Prior Publication Data

US 2007/0068196 A1 Mar. 29, 2007

Related U.S. Application Data

(60) Continuation-in-part of application No. 11/010,591, filed on Dec. 13, 2004, now Pat. No. 7,140,200, which is a division of application No. 10/403,909, filed on Mar. 27, 2003, now Pat. No. 6,862,898, which is a continuation-in-part of application No. 10/104,141, filed on Mar. 21, 2002, now abandoned, and a continuation-in-part of application No. 10/156,609, filed on May 24, 2002, now Pat. No. 6,772,580.

(51) Int. Cl.

| | |
|---|---|
| ***A44C 25/00*** | (2006.01) |
| ***A44C 17/02*** | (2006.01) |
| ***A44C 7/00*** | (2006.01) |

(52) U.S. Cl. ..... 63/37; 63/28; 63/13; 63/23; 63/26

(58) Field of Classification Search ..... 63/13, 63/23, 26, 28; 359/536
See application file for complete search history.

(56) References Cited

U.S. PATENT DOCUMENTS

| | | | | | |
|---|---|---|---|---|---|
| 195,304 | A | * | 9/1877 | Nelson | 63/28 |
| 860,204 | A | * | 7/1907 | Fishel | 63/28 |
| 951,926 | A | * | 3/1910 | White | 63/33 |
| 964,624 | A | * | 7/1910 | Doran | 29/10 |
| 1,943,658 | A | * | 1/1934 | Dyckma | 428/51 |
| D97,606 | S | * | 11/1935 | Kiebanoff | D11/92 |
| D108,551 | S | * | 2/1938 | Rufeisen | D11/92 |
| 2,199,222 | A | * | 4/1940 | Glaenzer | 63/32 |
| 2,774,231 | A | * | 12/1956 | Peterson | 63/28 |
| 2,887,746 | A | * | 5/1959 | Bogoff | 164/9 |
| 3,751,795 | A | * | 8/1973 | Favre | 29/558 |
| 3,931,719 | A | * | 1/1976 | Schwab | 63/28 |
| 4,243,626 | A | * | 1/1981 | Prete | 264/153 |
| 4,809,417 | A | * | 3/1989 | Normann, Jr. | 29/896.41 |
| 5,072,601 | A | * | 12/1991 | Slowinski | 63/28 |
| 5,077,988 | A | * | 1/1992 | Poll | 63/26 |
| 5,377,506 | A | * | 1/1995 | Tranzer | 63/28 |
| 5,488,839 | A | * | 2/1996 | Udko | 63/28 |
| 5,632,164 | A | * | 5/1997 | Bergagnini | 63/23 |
| 5,848,539 | A | * | 12/1998 | Ouzounian | 63/28 |
| 6,065,308 | A | * | 5/2000 | Piat et al. | 63/37 |
| 6,318,121 | B1 | * | 11/2001 | Pachauer | 63/26 |

* cited by examiner

*Primary Examiner*—David Reese
(74) *Attorney, Agent, or Firm*—Ostrolenk Faber LLP

(57) ABSTRACT

An article of jewelry including a body having an outer major surface and a decorative pattern formed on the outer surface of the body, the pattern including pairs of intersecting grooves and an optically transparent synthetic decorative element that includes admixed glitter, diamond dust, or both formed in a respective well created by the intersection of each pair of intersecting grooves.

19 Claims, 3 Drawing Sheets

ARTICLE OF JEWELRY

FIELD OF THE INVENTION

The present invention relates to an article of jewelry that includes a decorative pattern on an outer surface thereof and a method for forming the article of jewelry.

BACKGROUND OF THE INVENTION

Texture renders the exterior surface of an article of jewelry more brilliant. Diamond cutting is a conventional jewelry making technique for creating texture surfaces on the surface of an article of jewelry made from a metal such as gold, silver, platinum and the like. Diamond cutting involves the use of a very sharp, knife-like instrument which cuts into the metallic surface of an article of jewelry. Essentially, the purpose of diamond cutting is to form light reflective surfaces in different orientations to reflect light in multiple directions to create the effect of a light kaleidoscope which results in a brilliant sparkle that enhances the beauty of the article of jewelry.

Many patterns may be created by diamond cutting each with a different and unique light kaleidoscope effect. Prior patents of the assignee of the present application describe methods for forming unique patterns on an article of jewelry by diamond cutting, which include pairs of intersecting grooves each surrounded by a plurality of grooves. They describe a method for forming an article of jewelry which includes mounting natural or man-made jewels such as precious gemstones, semiprecious gemstones and gem-like articles like enamel in designated positions within the unique pattern created to take advantage of the combination of the light Kaleidoscope effect of the pattern and the natural beauty of the jewels. Such a method results in an article of jewelry with a pleasing decorative pattern. However, due to the fact that a relatively high number of jewels must be mounted to achieve the decorative pattern, it is not cost effective to manufacture such articles of jewelry for large consumer markets. In the jewelry industry, combining precious or semi-precious stones with synthetic stones is well know to reduce cost. For example, it is well known to include a single diamond (precious stone) with a plurality of cubic zirconia (synthetic stone) to obtain an article of jewelry with a pleasing appearance, but a reduced cost, which renders the article of jewelry more suitable for a larger market. Such a method, however, still requires a mounting step for each individual stone resulting in an increase in the cost of each article.

It is thus desirable to obtain a pleasing decorative pattern by other methods and other materials that results in an article of jewelry for a wider market.

SUMMARY OF THE INVENTION

An article of jewelry according to the preferred embodiment of the present invention includes a body which may be made from a precious metal, such as an alloy of gold, silver or platinum, having an exterior surface that includes a pattern of intersecting grooves. Each groove includes light reflective surfaces of a different orientation to reflect light in different directions. A decorative element is formed preferably in a well created by the intersection of each pair of intersecting grooves and covers at least a portion of the light reflective surfaces. Each decorative element is made from an optically transparent synthetic material that exhibits good adhesion to the material that forms the body of the article of jewelry. The optical transparency of the material that forms each decorative element allows for passage of light, which is then reflected in multiple directions and re-transmitted through the decorative element thereby creating a pleasing jewel-like appearance.

A preferred material for forming each decorative element is a thermally curable colored or colorless epoxy. Other epoxies such as a UV curable epoxy may be used without departing from the spirit of the present invention. According to one aspect of the present invention a dab of thermally curable epoxy is deposited over a respective intersection of each pair of intersecting grooves and then thermally cured in an oven. As a result, decorative elements are formed on the body of the article of jewelry with good adhesion thereby obviating the need for a separate mounting step.

According to another aspect of the present invention, each pair of intersecting grooves may be surrounded by a plurality of grooves, each of which includes light reflective surfaces which add to the light kaleidoscope effect. The plurality of grooves that surround each pair of intersecting grooves may be arranged to form a quadrilateral such as a square.

According to another aspect of the invention, at least one precious or semiprecious stone or a synthetic stone may be temporarily set over an intersection of a respective pair of intersecting grooves by epoxy during the deposition of epoxy for forming the decorative elements and fixed in place during the curing stage. Depending on the height of the stone, a hole may be drilled at the site of the intersection of the intersecting grooves to accommodate the stone. For example, a stone having a height that is larger than the depth of the well created by the intersection of the intersecting grooves may require a hole to be properly fitted in place. It should be noted that depending on the width of the jewel, the hole may remove a substantial portion or all of the reflective surfaces created by the intersecting grooves. In such a case, when the jewel is fixed in place, the facets of the jewel reflect the light, thereby allowing the jewel to blend with the rest of the pattern. As a result, a jewel and the decorative elements may be used to create a decorative pattern as desired without a need for a separate mounting step for mounting the jewel. Given that the epoxy used for mounting the jewel is optically transparent, light that is transmitted through the jewel is reflected in multiple directions from the light reflective surfaces of the intersecting grooves and re-transmitted through the jewel, thereby creating a complex pattern of light that emanates from the jewel to enhance the beauty of the article of jewelry. In case there is little reflection from the surfaces behind the jewel (e.g. when surfaces have been removed by drilling a hole) the epoxy may reflect the light thereby adding to the play of light in the jewel and further helping the jewel to blend with the rest of the pattern.

A technique according to the present invention allows the designer to combine a small number of relatively expensive jewels with a much greater number of relatively inexpensive synthetic decorative elements of the present invention to obtain a complex decorative pattern that conveys the impression that the entire pattern is made using jewels with considerably less expense than a pattern created by the mounting of individual precious or semi-precious stones, or synthetic jewels. For example, a single gemstone such as a diamond may be used as a centerpiece in a design in combination with other colored or colorless decorative elements as background pieces to create the impression that the entire pattern is formed with gemstones, which enhances the marketability of the article of jewelry without the cost involved in producing the entire pattern with gemstones.

According to another aspect of the present invention the pattern may include a plurality of pairs of intersecting grooves arranged side-by-side in a two dimensional matrix, a single row or a plurality of intersecting rows as desired. Also, a pattern according to the present invention may be formed on a flat or a curved surface.

An advantage of the present invention is that it may be implemented on the curved outer surface of a hollow piece of jewelry which comprises a thin piece of metal surrounding a space, such as a tubular piece of jewelry. Jewelers often use a thinned piece of metal to form such articles to obtain a relatively larger article while saving cost by using as little material as possible. Mounting of jewels and other articles on the curved surface of such articles according to conventional mounting techniques requires additional steps and materials, which increase the cost of such articles. The present invention, however, allows the mounting of jewels and decorative elements on the curved outer surface of thinned metal that forms a hollow body of an article of jewelry thereby allowing for the formation of complex decorative patterns without the need for additional mounting steps, materials or structures, i.e., jewel settings.

According to another aspect of the invention, not described in the present assignee's prior patents, the aforementioned synthetic stones are formed of an epoxy in which there has been preadmixed glitter material, or diamond dust, or a combination of glitter material and diamond dust. Glitter material, as used herein, refers to flakes of polished metal particles. Diamond dust, as its name suggests, is well known in the industry and consists of crystalline diamond matter which has been finely ground or mined in a dust form and which can be used as an additive in the epoxy which forms the synthetic stones.

The instant inventor has discovered that admixing glitter in the epoxy slurry that is placed in the wells formed on the surface of a jewelry piece creates within each synthetic stone, many thousands of light reflecting surfaces above the diamond cut surfaces on the jewelry piece itself. These surfaces further disperse and refract light in all directions, recreating a kaleidoscope effect which appreciably enhances the overall appearance and beauty of the jewelry piece. That kaleidoscope effect is further enhanced by also adding an optional diamond dust, which is itself a crystalline matter particularly suitable and effective for dispersing and creating a bright reflection effect, which directs and redirects lights in all directions to produce a more beautiful jewelry piece. In fact, the applicant prefers to form the jewelry piece with both glitter and diamond dust admixed with one another in proportions that can be selected to suit the individual needs of a particular designer or retail customer.

A slurry, consisting of the aforementioned curable epoxy, in which the glitter and/or diamond dust has been admixed, is located in a syringe and the syringe is thereafter used to carefully meter out a precise amount of the epoxy (admixed with glitter/diamond dust), so that the effect is to mimic and replicate or simulate the appearance of an actual diamond. If desired, the syringe can be controlled so that the epoxy synthetic stone is formed with a base, with a dome over the base to provide even more reflecting surfaces.

Other features and advantages of the present invention will become apparent from the following description of the invention which refers to the accompanying drawings.

DETAILED DESCRIPTION OF THE FIGURES

Figure 1:
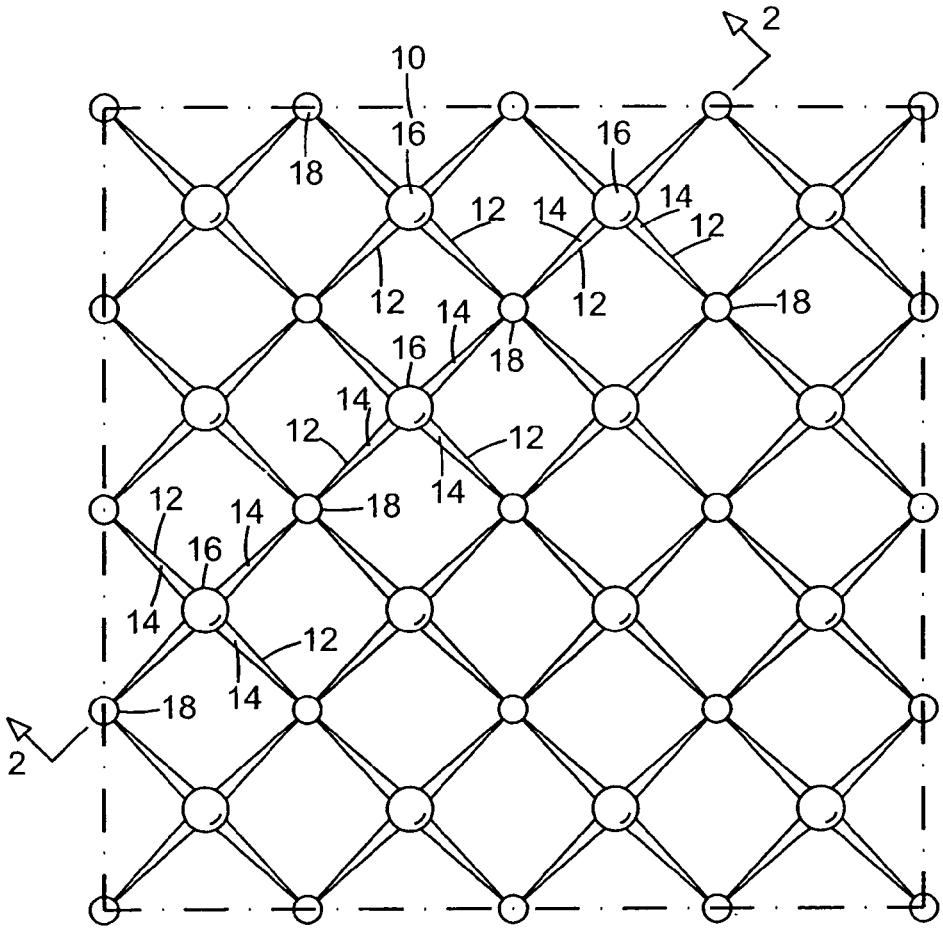
FIG. 1 shows a top plan view of a portion of an article of jewelry according to the present invention.

FIG. 1. shows a top view of a portion of a major surface 10 of an article of jewelry according to the present invention. Surface 10 is on the exterior of the body of an article of jewelry. According to the present invention, major surface 10 includes a plurality of intersecting grooves 12 that extend from major surface 10 to a predetermined depth into the body of the article of jewelry.

Figure 2:
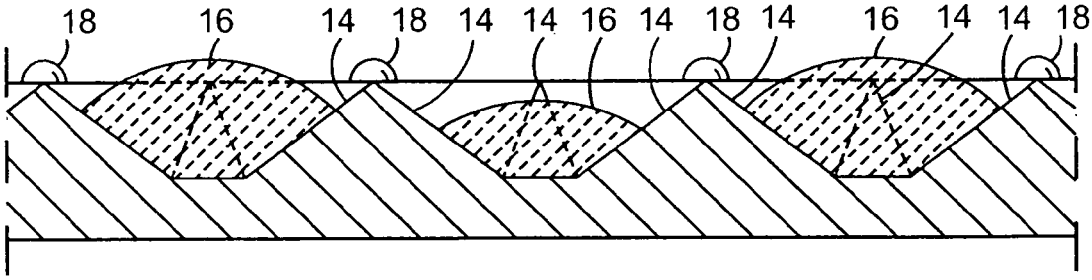
FIG. 2 shows a cross-sectional view along line 2-2 in FIG. 1 as viewed in the direction of the arrows.

Referring to FIG. 2, each groove 12 includes light reflective surfaces 14. The presence of light reflective surfaces 14 enhances the overall light reflection from major surface 10 and thus adds to the brilliance of the article of jewelry as a whole. Intersecting grooves 12 are preferably formed by a cutting knife used in the jewelry industry for cutting decorative patterns on the surfaces of articles of jewelry according to a well known method referred to as diamond cutting. The technique for forming the mutually crossing grooves 12 is explained in detail in the co-pending U.S. patent applications Ser. Nos. 10/104,141 and 10/156,169, the subject matter of which is incorporated by reference.

A well 15 (FIG. 4) is present at the point of intersection of intersecting grooves 12. According to the preferred embodiment of the present invention decorative elements 16 are formed in the well 15 which is present at the intersection of each pair of intersecting grooves 12. Each decorative element extends over and covers portions of light reflective surfaces 14 of a corresponding pair of intersecting grooves 12. It should be noted that decorative elements 16 may extend outside of the well 15 present at the intersection of intersecting grooves 12, or may be wholly contained therein as shown by FIG. 2

According to one aspect of the present invention, decorative elements 16 are formed from an optically transparent synthetic material which exhibits good adhesion to major surface 10. Materials such as thermally curable or UV curable epoxies such as such thermally curable enamel epoxy as used in jewelry applications and also used in automotive applications for exterior coating are examples of materials which exhibit the desired optical transparency and adhesion qualities. The optically transparent synthetic material used for forming decorative elements 16 may be colored, colorless or any combination thereof to achieve any desired overall decorative effect. Each decorative element 16, according to the present invention, allows for the transmission of light to light reflective surfaces 14 over which the decorative element 16 is disposed. The light so transmitted is then reflected by light reflective surfaces 14 in multiple directions and re-transmitted through decorative element 16. As a result, an optical effect is obtained which gives each decorative element 16 the appearance of a jewel. It is noteworthy that because decorative elements 16 are formed from an optically transparent synthetic material that adheres well to major surface 10, there is no need for a separate mounting step or structures, i.e. a setting, which may be required if precious, semiprecious, or synthetic stones or glass articles are used.

An article of jewelry according to the present invention is manufactured by first forming intersecting grooves 12 by a cutting knife as explained in detail in the co-pending U.S. patent applications Ser. Nos. 10/104,141 and 10/156,609. Next, a dab of thermally curable epoxy is deposited preferably in each well 15 created by the intersection of each pair of intersecting crossing grooves 12. Each dab of thermally curable epoxy should be enough to cover at least a portion of light reflective surfaces 14 of each pair of intersecting grooves. Next, the article of jewelry is heated to an appropriate temperature to cure the epoxy to form decorative elements 16. To achieve the best impression decorative elements 16 should not be larger than 4 points (jeweler's scale) and is preferably between 3 points or smaller.

According to one aspect of the present invention, at least one natural (precious or semiprecious stone) or man-made (synthetic stone) jewel may be temporarily fixed over the intersection point of a pair of intersecting grooves 12 by a small amount of epoxy. Depending on the height of the jewel, a hole may be drilled at the intersection of the intersecting grooves so that the jewel may be properly received. For example, if the height of the jewel is larger than the depth of the well created by the intersection of the intersecting grooves a hole may be drilled at the site of the installation of the jewel so that the jewel may be properly installed in place. It should also be noted that depending on the width of the jewel, the hole may remove a substantial portion or all of the reflective surfaces created by a pair of intersecting grooves. In such a case, the facets of the jewel reflect the light thereby allowing the jewel to blend with the rest of the pattern. When the article of jewelry is exposed to heat during the epoxy curing step, the jewel is fixed in place. As a result, light which is reflected in multiple directions from light reflective surfaces 14 of the intersecting grooves 12 over which the jewel is affixed is re-transmitted through the jewel through the optically transparent epoxy. Advantageously, due to the optical transparency of the epoxy, light is transmitted through to the light reflective surfaces and re-transmitted to the jewel with less interference. Also, because the cured epoxy may have a different index of refraction than the jewel, the direction of light is changed, further adding to the complexity of the play of light inside the body of the jewel. As a result, the brilliance of the jewel is enhanced. This result is an improvement over the prior art technique of using glue to adhere a jewel to a surface of an article of jewelry in that, contrary to the prior art technique, the amount of interference by the adhesive layer is reduced when an optically transparent epoxy is used. In case there is little reflection from the surfaces behind the jewel (e.g. when surfaces have been removed by drilling a hole) the epoxy may reflect the light thereby adding to the play of light in the jewel, an further helping the jewel to blend with the rest of the pattern.

It should be noted that the present invention is not limited to the use of thermally curable epoxies and other epoxies such as UV curable epoxies may also be used without departing from the spirit of the invention.

Optionally, to enhance the appearance of the article of jewelry, more decorative articles 18 such as natural (precious or semiprecious stones) or man-made (synthetic stones) jewels or colored glass may be mounted at the respective ends of each groove 12 by any known means.

Figure 3:
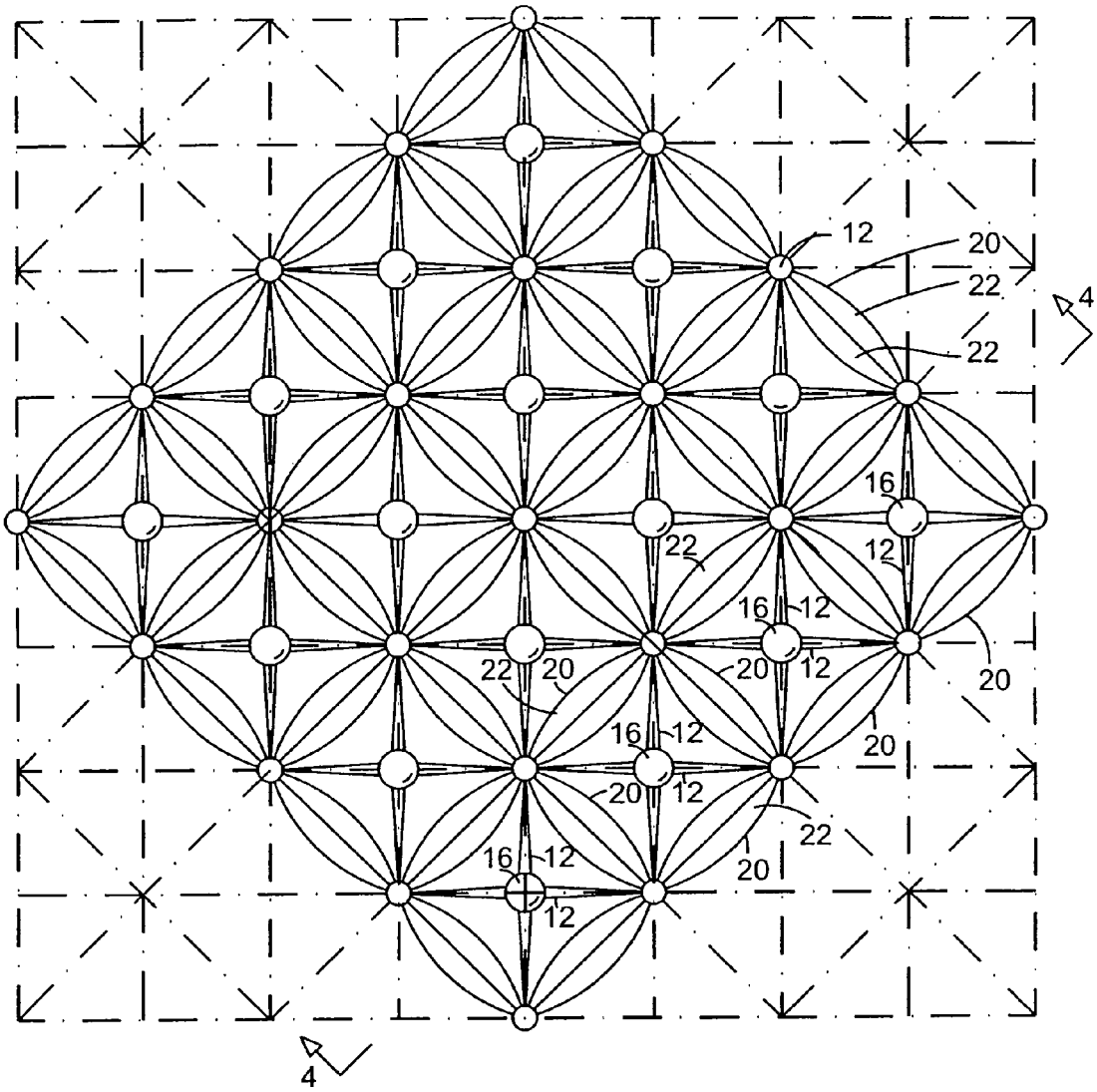
FIG. 3 shows a top plan view of a portion of an article of jewelry according to the present invention including additional features.
Figure 4:
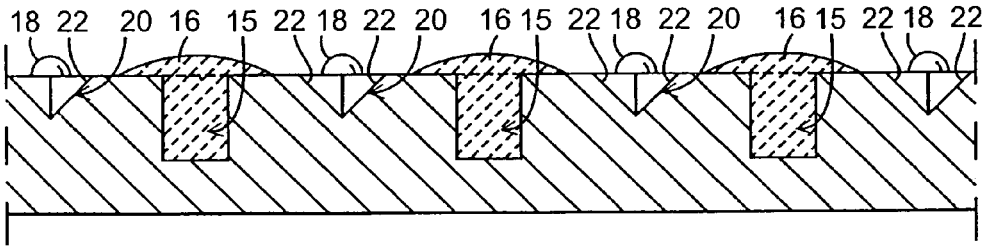
FIG. 4 shows a cross-sectional view along line 4-4 as viewed in the direction of the arrows.

Referring now to FIGS. 3 and 4, according to another aspect of the present invention, an article of jewelry according to the present invention may be further enhanced by forming a plurality of non-intersecting grooves 20 around each pair of intersecting grooves 12. Each non-intersecting groove 20 provides additional light reflective surfaces 22 which enhance the appearance of the article of jewelry. Optionally, decorative elements 16 may be formed on the mesas that are created by the intersecting grooves 12 that are disposed inside the non-intersecting grooves 20. Such decorative elements may receive light from the reflective surfaces 22 of the non-intersecting grooves 22, as well as reflective surfaces 14 of the intersecting grooves 12 to provide a jewel-like appearance.

According to a preferred embodiment of the present invention non-intersecting grooves 20 may be arranged in a quadrilateral around each pair of intersecting grooves 12. For example, as shown in FIG. 3, non-intersecting grooves 20 may be arranged in a square around each pair of intersecting grooves 12. Non-intersecting grooves 20 may be arranged in other quadrilateral forms such as a rectangle or a rhombus.

Figure 7:
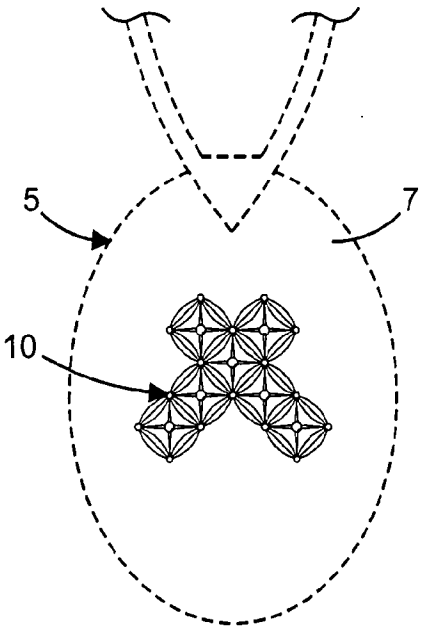
FIG. 7 shows an article of jewelry according to the present invention with an intersecting pattern.
Figure 6:
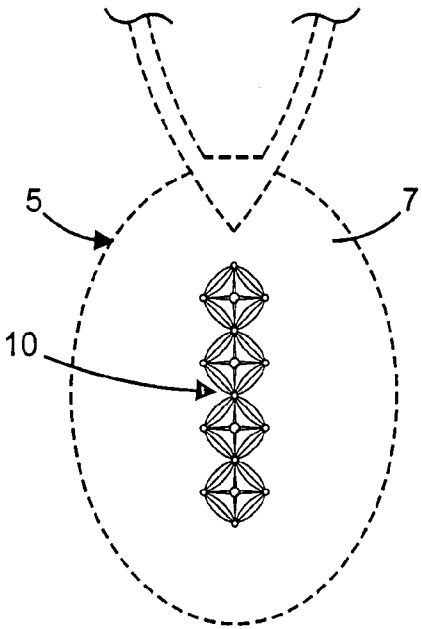
FIG. 6 shows an article of jewelry according to the present invention with a single row pattern.
Figure 5:
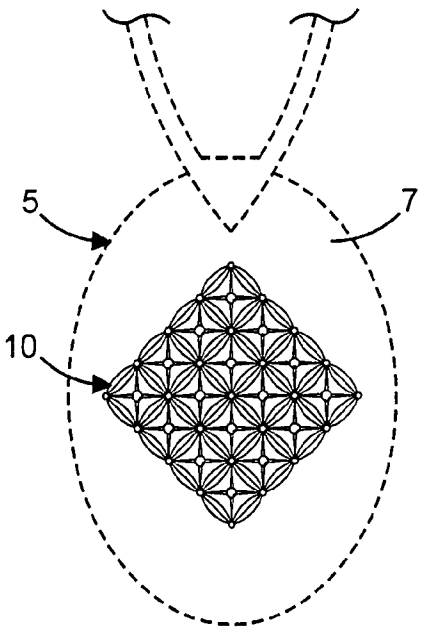
FIG. 5 shows an article of jewelry according to the present invention with a two dimensional lattice pattern.

FIG. 5 shows an article of jewelry 5 according to the present invention. As shown in FIG. 5, as well as FIGS. 1 and 3, intersecting grooves 12 may be arranged side-by-side on a major surface 10 of body 7 of article of jewelry 5 in a two dimensional matrix. Intersecting grooves 12 may also be arranged in a single row, or one or more intersecting rows as shown by FIGS. 6 and 7 respectively, or in parallel rows.

Figure 8:
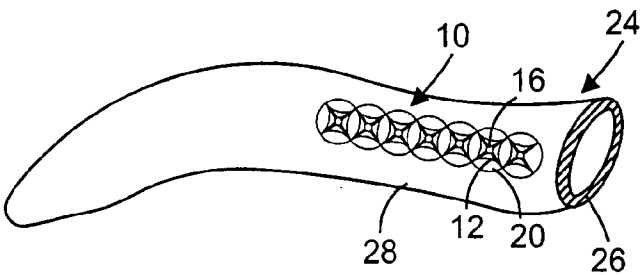
FIG. 8 shows an article of jewelry according to the present invention having a hollow body.

Major surface 10, on which intersecting grooves 12, decorative elements 16, and other features described herein are formed may be flat (FIG. 5) or curved (FIG. 8). For example, as shown in FIG. 8, it is a conventional technique in the jewelry art to form a hollow article of jewelry 24 out of a thinned piece of metal 26. For example, it is a common practice to form a hollow tube out of a thinned piece of gold in order to obtain a relatively large piece without having to expend a large quantity of gold, thereby saving in cost. Such articles often have curved outer surfaces which may be adorned with jewels. To adorn the outer surface of such articles with jewels and other decorative articles special mounting techniques are usually used which add to the cost. Referring to FIG. 8, according to one aspect of the present invention jewels may be mounted on the curved outer surfaces 26 of such articles over a pair of intersecting grooves 12 without the need for any other technique. In addition, decorative elements 16 may be formed on the outer surface 26 of such articles with relative ease.

The body of an article of jewelry having a major surface 10 for receiving decorative elements 16 according to the present invention may be made from a metal. The metal may be a precious metal such as an alloy of gold, silver, or platinum. Also, a jewel 18 used in an article of manufacture according to the present invention may be a precious stone, such as a diamond, or a semiprecious stone such as cubic zirconia.

According to another aspect of the invention, not described in the present assignee's prior patents, the aforementioned synthetic stones are formed of an epoxy in which there has been preadmixed glitter material, or diamond dust, or a combination of glitter material and diamond dust. Glitter material, as used herein, refers to flakes of polished metal particles. Diamond dust, as its name suggests, is well known in the industry and consists of crystalline diamond matter which has been finely ground or mined in a dust form and which can be used as an additive in the epoxy which forms the synthetic stones.

The instant inventor has discovered that admixing glitter in the epoxy slurry that is placed in the wells formed on the surface of a jewelry piece creates within each synthetic stone, many thousands of light reflecting surfaces above the diamond cut surfaces on the jewelry piece itself. These surfaces further disperse and refract light in all directions, recreating a kaleidoscope effect which appreciably enhances the overall appearance and beauty of the jewelry piece. That kaleidoscope effect is further enhanced by also adding an optional diamond dust, which is itself a crystalline matter particularly suitable and effective for dispersing and creating a bright reflection effect, which directs and redirects lights in all directions to produce a more beautiful jewelry piece. In fact, the applicant prefers to form the jewelry piece with both glitter and diamond dust admixed with one another in proportions that can be selected to suit the individual needs of a particular designer or retail customer.

A slurry, consisting of the aforementioned curable epoxy, in which the glitter and/or diamond dust has been admixed, is located in a syringe and the syringe is thereafter used to carefully meter out a precise amount of the epoxy (admixed with glitter/diamond dust), so that the effect is to mimic and replicate or simulate the appearance of an actual diamond. If desired, the syringe can be controlled so that the epoxy synthetic stone is formed with a base, with a dome over the base to provide even more reflecting surfaces.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An article of jewelry comprising:

a body having formed on a major surface thereof at least one pair of intersecting first grooves crossing at an intersection and formed by diamond cutting, each said intersecting first groove including light reflective surfaces oriented in different directions and forming a well having a bottom at the intersection of the intersecting first grooves and said well being arranged in a closely spaced matrix that includes at least one line of wells; and a decorative element disposed over and attached to at least portions of said light reflective surfaces, said decorative element being comprised of an optically transparent synthetic material having surfaces that are complementary to the shape of the light reflecting surface within said well, whereby light that is transmitted through said decorative element is received by said light reflective surfaces and reflected in multiple directions and re-transmitted through said decorative element, wherein the decorative element is formed of a curable, colorless and transparent epoxy in which there is admixed glitter or diamond dust or a combination of glitter and diamond dust.

2. An article of jewelry according to claim 1, further comprising a plurality of second light reflective surfaces disposed around said one pair of intersecting first grooves.

3. An article of jewelry according to claim 2, wherein said plurality of second light reflective surfaces are arranged to form a quadrilateral.

4. An article of jewelry according to claim 1, wherein said decorative element is up to 4 points in size in jeweler's scale.

5. An article of jewelry according to claim 1, further comprising:

at least one pair of intersecting third grooves crossing at an intersection point formed in said major surface of said body, each of said third grooves including light reflective surfaces; and a jewel disposed over and attached to at least portions of said light reflective surfaces by an optically transparent adhesive, whereby light that is transmitted through said jewel is received by said light reflective surfaces and reflected in multiple directions and re-transmitted through said jewel.

6. An article of jewelry according to claim 5, wherein said optically transparent adhesive includes a synthetic polymer.

7. An article of jewelry according to claim 6, wherein said synthetic polymer is an epoxy.

8. An article of jewelry according to claim 5, further comprising a plurality of light reflective surfaces disposed around said at least one pair of intersecting third grooves.

9. An article of jewelry according to claim 8, wherein said plurality of reflective surfaces are arranged to form a quadrilateral.

10. An article of jewelry according to claim 1, wherein said major surface is curved.

11. An article of jewelry according to claim 1, wherein said major surface is flat.

12. An article of jewelry according to claim 1, wherein a thinned layer of metal surrounding a hollow space forms said body.

13. An article of jewelry according to claim 1, wherein said body is comprised of a metal.

14. An article of jewelry according to claim 13, wherein said metal is one of an alloy of gold, platinum and silver.

15. An article of jewelry according to claim 5, wherein said jewel is one a precious stone and a semi-precious stone.

16. An article of jewelry according to claim 15, wherein said semi-precious stone is a cubic zirconia.

17. An article of jewelry according to claim 15, wherein said precious stone is a diamond.

18. An article of jewelry according to claim 1, further comprising a jewel mounted in a hole in said body.

19. An article of jewelry according to claim 1, wherein said glitter comprises flakes of polished metal particles.

* * * * *